US008303430B2

(12) United States Patent
Li

(10) Patent No.: US 8,303,430 B2
(45) Date of Patent: Nov. 6, 2012

(54) COMBINATION BASE FOR A GOLF PRACTICE ARTIFICIAL SOD

(76) Inventor: Ching-Cheng Li, Taipei Hsien (TW)

( * ) Notice: Subject to any disclaimer, the term of this patent is extended or adjusted under 35 U.S.C. 154(b) by 0 days.

(21) Appl. No.: 12/471,477

(22) Filed: May 26, 2009

(65) Prior Publication Data

US 2010/0304880 A1 Dec. 2, 2010

(51) Int. Cl.
*A63B 69/36* (2006.01)

(52) U.S. Cl. ..... 473/278; 473/729

(58) Field of Classification Search ..... 473/157–164, 473/262, 278, 279; 428/17, 88, 92, 97
See application file for complete search history.

(56) References Cited

U.S. PATENT DOCUMENTS 3,735,988 A * 5/1973 Palmer et al. ..... 473/162
4,287,693 A * 9/1981 Collette ..... 52/177
4,497,858 A * 2/1985 Dupont et al. ..... 428/44
5,292,130 A * 3/1994 Hooper ..... 473/279
D483,499 S * 12/2003 Payne ..... D25/113
6,672,971 B2 * 1/2004 Barlow ..... 473/162
7,568,980 B1 * 8/2009 Janus et al. ..... 473/278
2003/0190969 A1 * 10/2003 Barlow et al. ..... 473/157
2007/0042829 A1 * 2/2007 Dennesen ..... 473/162

* cited by examiner

*Primary Examiner* — Nini Legesse

(57) ABSTRACT

A combination base for a golf practice artificial sod is formed by a number of combination plates for placing the artificial sod on the combination base. Each combination plate is made of foaming PU (Polyurethane) and has a protruding edge to extend upwardly. The protruding edge has a first end formed with a concave hole and a second end formed with a protruding block. The concave hole is connected to a relative protruding block of another adjacent combination plate. Each combination plate has a connecting edge formed with continuous convex teeth and notches to engage with the convex teeth and the notches of a relative connecting edge of an adjacent combination plate.

3 Claims, 8 Drawing Sheets

Fig. 1 (PRIOR ART)

Fig. 2 (PRIOR ART)

COMBINATION BASE FOR A GOLF PRACTICE ARTIFICIAL SOD

BACKGROUND OF THE INVENTION

1. Field of the Invention

The present invention relates to a combination base, and more particularly to a combination base for a golf practice artificial sod.

2. Description of the Prior Art

Golf is a popular sport. Because it takes a lot of money, a golf practice facility is provided for a beginner to practice.

FIGS. 1 and 2 show a conventional golf practice artificial sod, which is composed of a concave base 91 to accommodate an artificial sod 92.

The conventional base 91 is formed integrally and made of rubber, which is heavy in weight and not resilient. This kind of base 91 is easy to hurt a golf club. In particular, the one-piece rubber base is heavy in weight and takes a lot of space, which is not convenient for transportation. These shortcomings must be improved.

SUMMARY OF THE INVENTION

According to the present invention, there is provided a combination base for a golf practice artificial sod, composed of a number of combination plates for placing the artificial sod on the combination base, each combination plate being made of foaming PU (Polyurethane) and having a protruding edge to extend upwardly, the protruding edge having a first end formed with a concave hole and a second end formed with a protruding block, the concave hole being connected to a relative protruding block of another adjacent combination plate, each combination plate having a connecting edge formed with continuous convex teeth and notches to engage with the convex teeth and the notches of a relative connecting edge of an adjacent combination plate.

The combination base for a golf practice artificial sod of the present invention is composed of four or two combination plates made of forming PU which provides resilience to the combination base. The present invention is not easy to hurt a golf club and is light in weight. The combination plates are able to be disassembled and stacked up for transportation, which takes less space, saves freightage cost and is easy to be assembled when in use. This improves the shortcomings of the conventional rubber base and metallic frame.

DETAILED DESCRIPTION OF THE PREFERRED EMBODIMENT

Embodiments of the present invention will now be described, by way of example only, with reference to the accompanying drawings.

Figure 1:
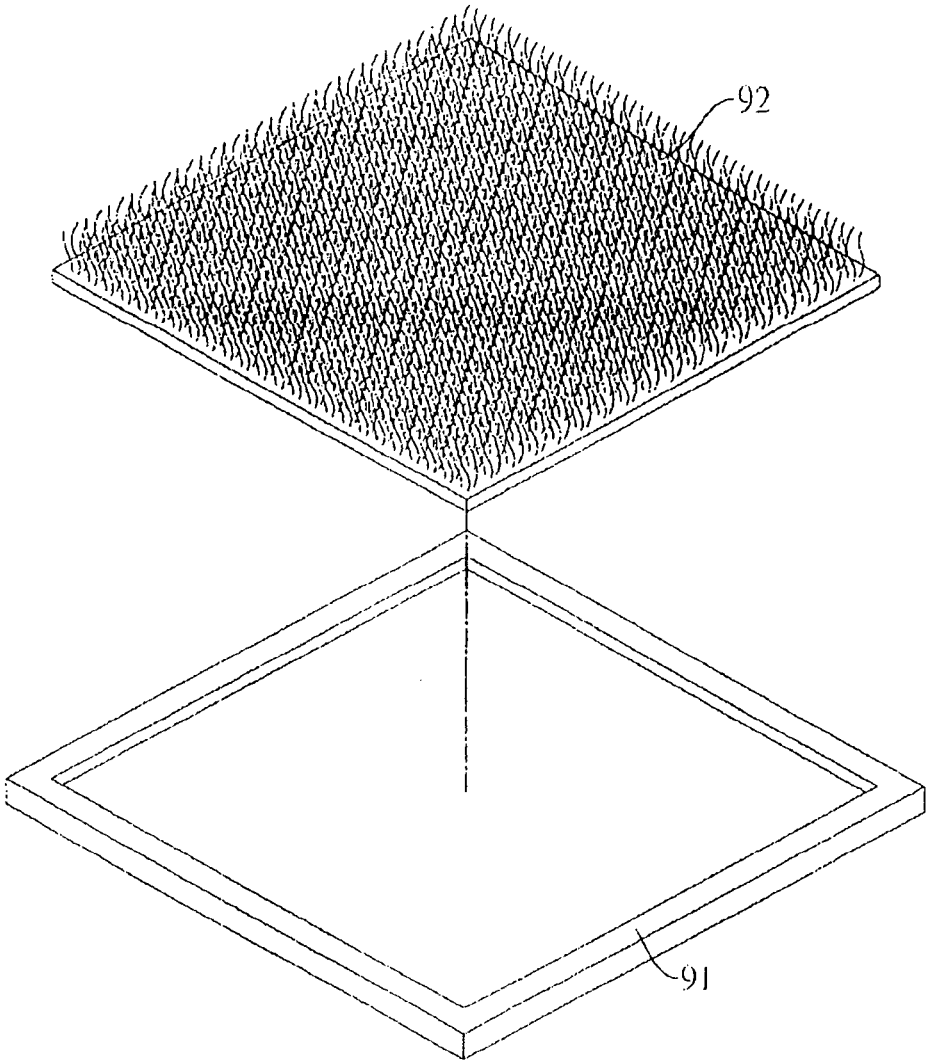
FIG. 1 is an exploded view of a conventional base integrated with an artificial sod.
Figure 2:
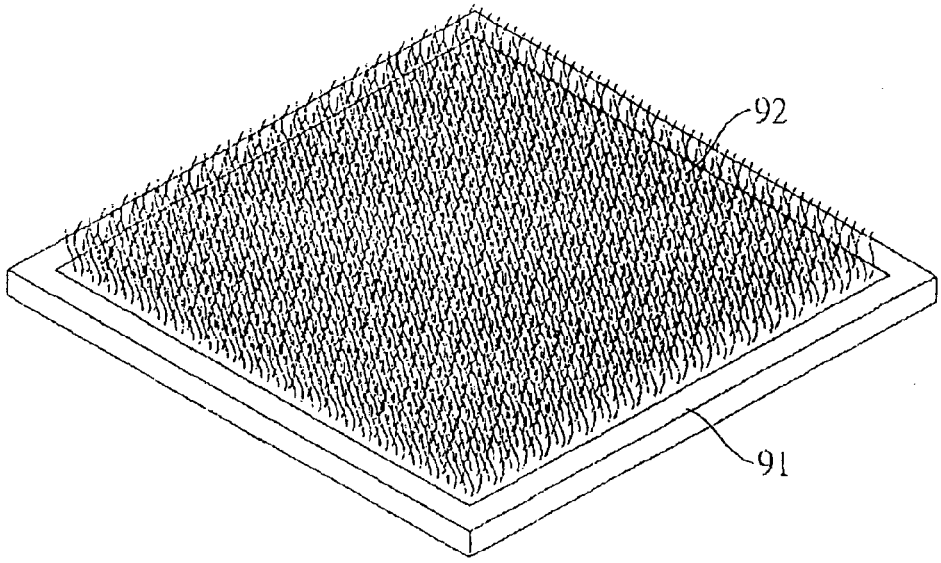
FIG. 2 is a perspective view of FIG. 1.
Figure 3:
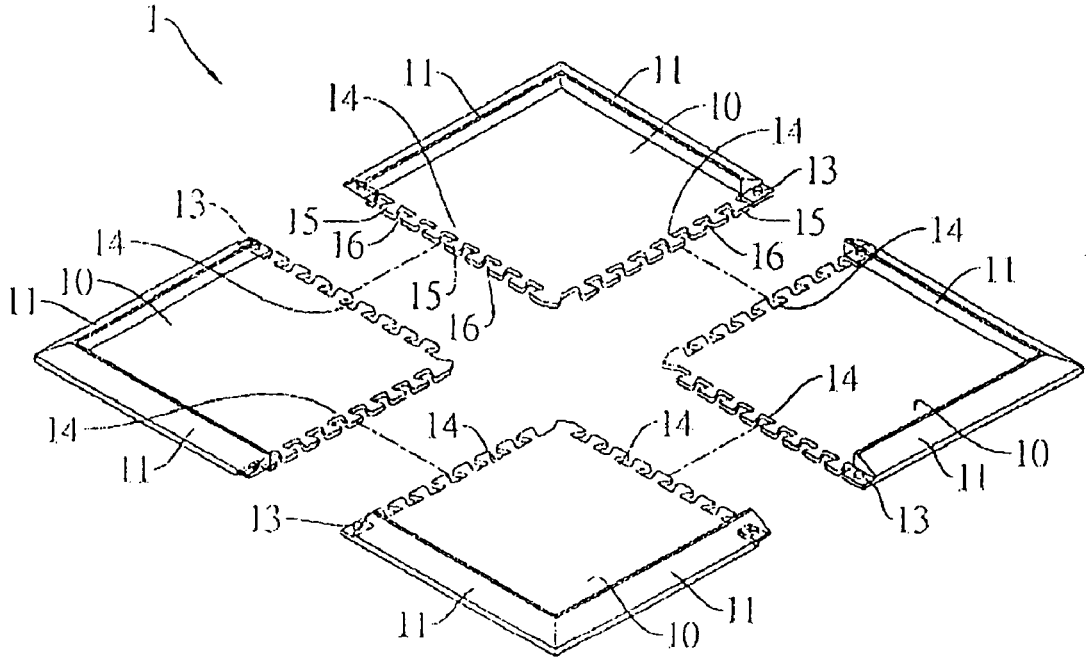
FIG. 3 is an exploded view of a first preferred embodiment of the present invention.
Figure 4:
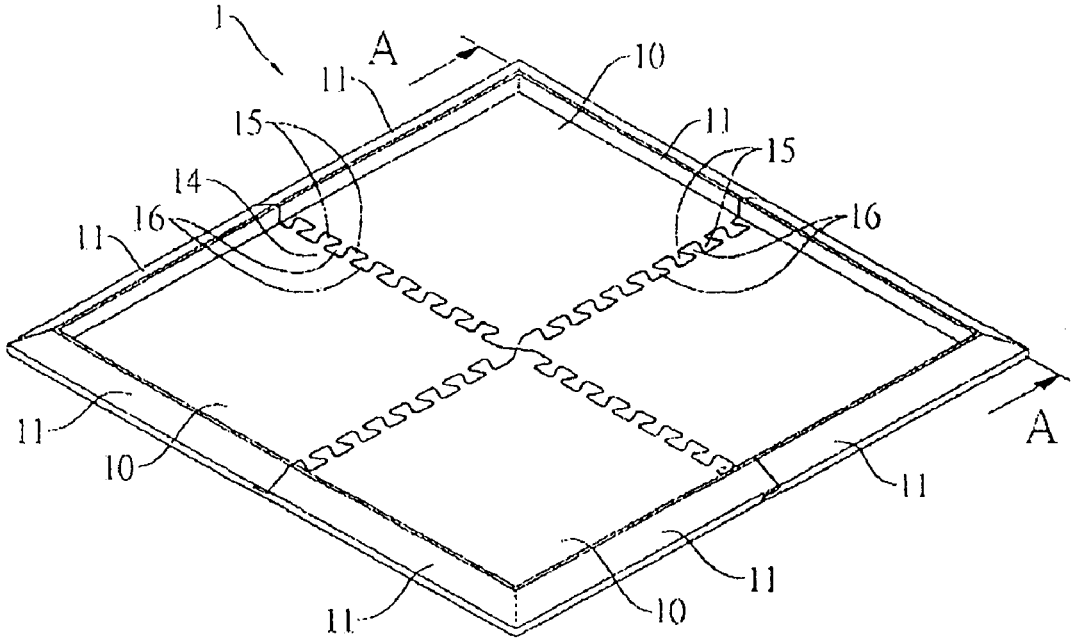
FIG. 4 is a perspective view of the first preferred embodiment the present invention.
Figure 4A:
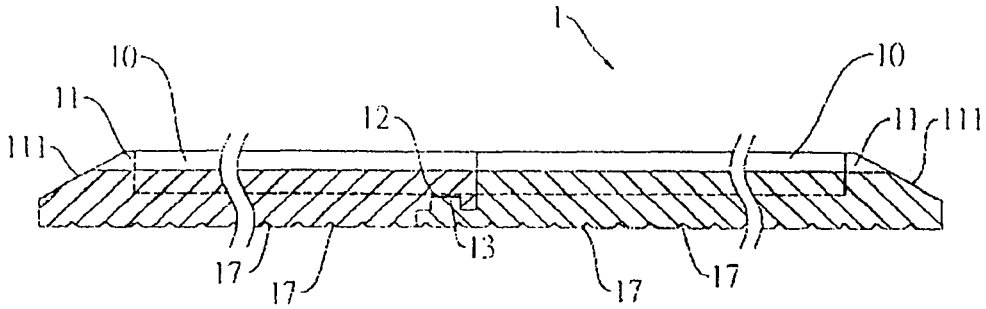
FIG. 4A is a cross-sectional view taken along line A-A of FIG. 4.
Figure 5:
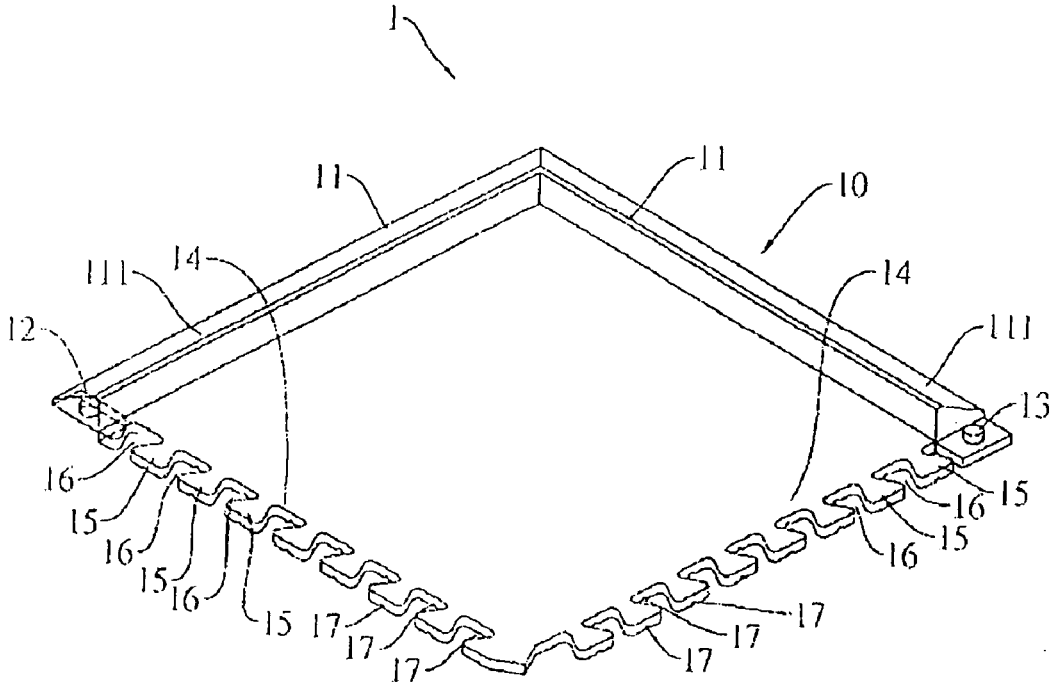
FIG. 5 is a perspective view of a single combination plate of the first preferred embodiment the present invention.

Referring to FIGS. 3 through 5, a combination base 1 according to a first preferred embodiment of the present invention is comprised of four combination plates 10 for placing an artificial sod on the combination base 1.

As shown in FIG. 5, each combination plate 10 is made of foaming PU (Polyurethane), and comprises a protruding edge 11 to extend upwardly. The protruding edge 11 has an inclined top face 111, a first end formed with a concave hole 12, and a second end formed with a protruding block 13. The concave hole 12 is connected to the protruding block 13 of another adjacent combination plate 10, as shown in FIG. 4. Each combination plate 10 has a connecting edge 14 formed with continuous convex teeth 15 and notches 16 to engage with the convex teeth 15 and the notches 16 of the relative connecting edge 14 of the adjacent combination plate 10 so as to form the combination base 1, as shown in FIG. 4.

In addition, each combination plate 10 has a bottom surface formed with a number of grooves 17 crossing each other, providing a skidproof function.

FIGS. 3 through 5 show the first preferred embodiment of the present invention. The combination base 1 is composed of the four combination plates 10. Each combination plate 10 is in a square shape. The protruding edge 11 is disposed at two adjacent sides, and the connecting edge 14 is disposed at opposite two sides thereof.

The combination base 1 for a golf practice artificial sod of the present invention is composed of a number of combination plates 10 made of foaming PU which provides resilience to the combination base 1. The present invention is not easy to hurt a golf club and is light in weight. The combination plates 10 are able to be disassembled and stacked up for transportation, which takes less space, saves freightage cost and is easy to be assembled when in use. This improves the shortcomings of the conventional rubber base and metallic frame.

Figure 6:
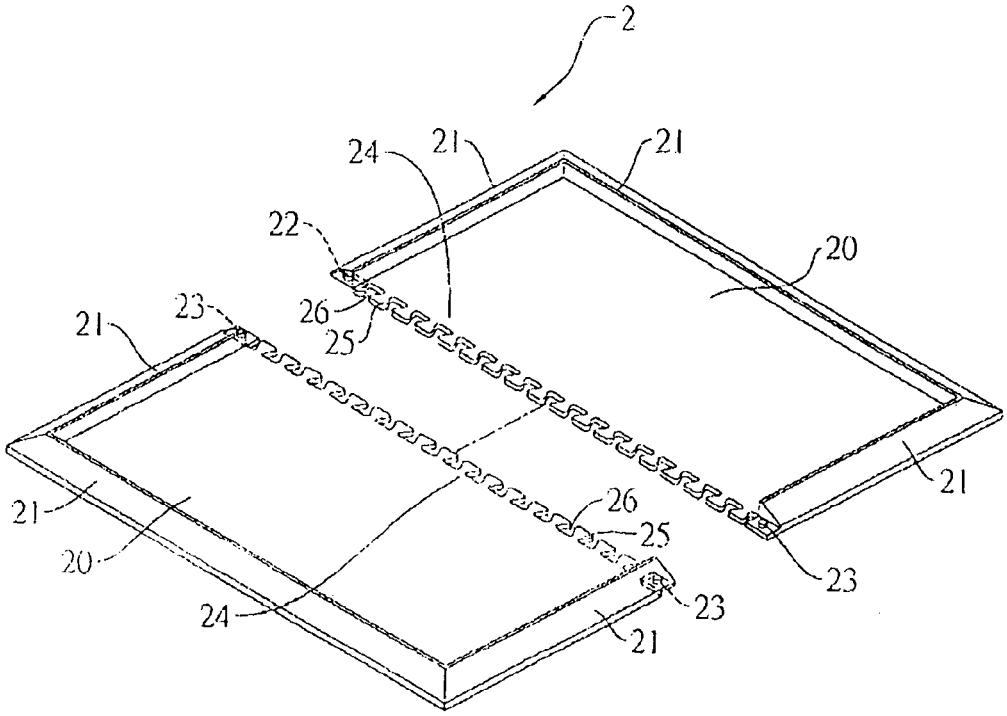
FIG. 6 is an exploded view of a second preferred embodiment of the present invention.
Figure 7:
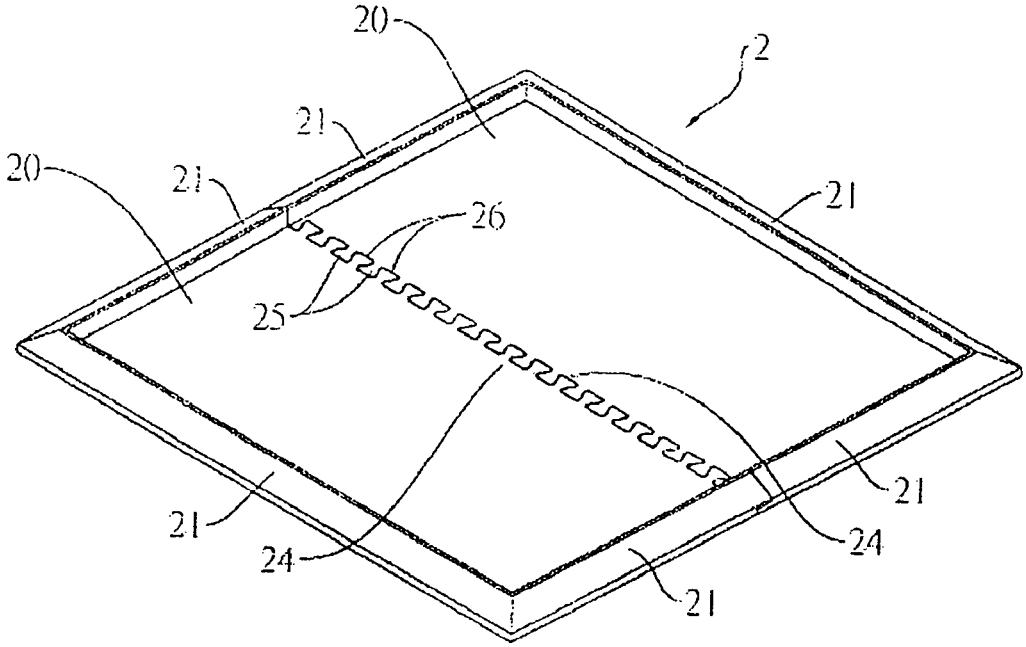
FIG. 7 is a perspective view of the second preferred embodiment the present invention.

Referring to FIGS. 6 and 7, a combination base 2 according to a second preferred embodiment of the present invention is composed of two combination plates 20. Each combination plate 20 is in a rectangle shape, and has a connecting edge 24 formed with continuous convex teeth 25 and notches 26 at a long side thereof and a protruding edge 21 at three sides thereof. The protruding edge 21 has a first end formed with a concave hole 22 and a second end formed with a protruding block 23. The concave hole 22 is connected to the protruding block 23 of another adjacent combination plate 20 to form the combination base 20, as shown in FIG. 7. The second preferred embodiment also provides the same advantages.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A combination base for a golf practice artificial sod, comprising:

at least one combination plates for placing an artificial sod on the combination base; each combination plate being made of foaming PU (Polyurethane), and comprising a protruding edge to extend upwardly; the protruding edge having an inclined top face, one bottom end of the protruding edge being formed with a concave hole, and another upper end of the protruding edge being formed with a protruding block; the concave hole being engaged with the protruding block of another adjacent combination plate; each combination plate having a connecting edge formed with continuous convex teeth and notches to engage with the convex teeth and the notches of the respective connecting edge (14 of the adjacent combination plate so as to form the combination base; and each combination plate having a bottom surface formed with a number of grooves crossing each other, providing a skidproof function.

2. The combination base for a golf practice artificial sod as claimed in claim 1, wherein the combination base is composed of four combination plates; and each combination plate has a square shape; the protruding edge is disposed at two adjacent sides, and the connecting edge is disposed at another two adjacent sides thereof.

3. The combination base for a golf practice artificial sod as claimed in claim 1, wherein the combination base (1) is composed of two combination plates; and each combination plate has a square shape; and the protruding edge is disposed at three adjacent sides, and the connecting edge is disposed at one side other than the protruding edge.

* * * * *